United States Patent [19]

Rao

[11] 4,388,556

[45] Jun. 14, 1983

[54] LOW NOISE ELECTRON GUN

[75] Inventor: Nidamboor V. Rao, Cumberland, R.I.

[73] Assignee: U.S. Philips Corporation, New York, N.Y.

[21] Appl. No.: 232,350

[22] Filed: Feb. 6, 1981

Related U.S. Application Data

[63] Continuation of Ser. No. 11,468, Feb. 12, 1979, which is a continuation-in-part of Ser. No. 877,080, Feb. 13, 1978.

[51] Int. Cl.[3] ..... H01J 29/46; H01J 29/56

[52] U.S. Cl. ..... 315/14; 313/389

[58] Field of Search ..... 315/12 R, 14, 382, 15, 315/16, 17; 313/365, 376, 382, 389, 414

[56] References Cited

U.S. PATENT DOCUMENTS

| | | | |
|---|---|---|---|
| 3,040,205 | 6/1962 | Walker | 315/14 |
| 3,548,250 | 12/1970 | Van Roosmalen et al. | 315/31 |
| 3,732,457 | 5/1973 | Ueno et al. | 315/15 |
| 3,894,261 | 7/1975 | Corson | 313/452 |
| 3,919,586 | 11/1975 | Holman | 313/382 |
| 4,169,239 | 9/1979 | Ehata et al. | 313/389 |

*Primary Examiner*—Theodore M. Blum

*Attorney, Agent, or Firm*—Marc D. Schechter

[57] ABSTRACT

Disclosed is an electron gun comprising a cathode, a first apertured anode spaced from said cathode and operated at a potential of between 5 and 30 volts positive with respect to the cathode. The gun further comprises a second apertured anode spaced from the first anode and operating at a potential of between 100 and 400 volts positive with respect to the cathode to produce a lens field in the region between the anodes which focusses the electrons emitted from the cathode at a cross-over therebetween. The cross-section of the beam produced by the gun is determined by the size of the aperture in the second anode and the beam current may be varied by changing the voltage on the first anode to thereby move the cross-over closer to or further away from the second anode so that a larger or smaller portion, respectively, of the electrons in the beam passes through the aperture.

10 Claims, 3 Drawing Figures

LOW NOISE ELECTRON GUN

This is a continuation, of application Ser. No. 011,468, filed Feb. 12, 1979, which was a continuation-in-part of application of Ser. No. 877,080, filed Feb. 13, 1978.

BACKGROUND OF THE INVENTION

1. Field of the Invention

The invention relates to a low noise electron gun for use in electron tubes such as storage tubes, camera tubes, display tubes and the like. The invention is particularly suited for use in beam deflection tubes in which the beam generated by the gun is scanned across a target responsive to electrons by a deflection coil system or the like to either display on or read information stored by the target.

2. Description of the Prior Art

A tube of this type is described, for example, in an article entitled "An Experimental Light-Weight Colour Television Camera" in Vol. 29, Philips Technical Review, No. 11, 1968, pages 325–335. The electron beam in the camera tube described in the article is generated by a triode gun having a cathode, a control grid which is at a negative potential with respect to the cathode and an anode which is at a positive potential with respect to the cathode. The control grid and anode form a lens which focusses the electrons emitted from the cathode to a spot or "cross-over" in the region of the anode. The cross-over is then imaged on a photoconductive target by an electron lens and scanned across the target by a deflection coil system. One important factor which affects both the resolution and the response rate of such camera tubes is the velocity distribution of the electrons in the beam. The velocity distribution is dependent on the temperature of the cathode and theoretically the best that can be obtained is a Maxwellian distribution corresponding to the actual cathode temperature. In practice, however, the velocity spread of the electrons is greater than that which would correspond to the Maxwellian distribution for the actual cathode temperature. One reason for the increased velocity spread is the interaction between electrons in the beam, particularly at the beam cross-over, since electrons moving along intersecting tracks will repel each other causing one to move faster and the other one to slow down. In addition, x-ray radiation emitted by electrons impinging on the anode and positive ions striking the cathode may also release fast electrons which increase the velocity or energy spread of the electron beam.

The beam velocity distribution imposes a lower limit on the diameter of the spot to which the scanned beam can be focussed on the target and hence the resolution of the camera tube. As stated earlier, the response rate, that is the speed with which the tube reacts to variations in the intensity of the incident light, is also affected by the electron velocity distribution. Ideally all elements of the target should be stabilized at the same potential after scanning. However, as the velocity distribution of the electrons in the beam increases, the electrons with excessively high energies will cause the target to be charged to a lower potential than that desired increasing the beam-discharge lag and adversely affecting the response rate of the tube.

For the above reasons, it has been proposed to reduce the electron velocity distribution in the beam by using an electron gun which does not have a beam cross-over.

U.S. Pat. Nos. 3,894,261 and 3,226,595, for example, disclose electron guns of this type comprising a cathode and an anode which is operated at low positive potential with respect to the cathode. U.S. Pat. No. 3,831,058 discloses another gun of this type having a cathode, an apertured control grid which is operated at a negative voltage relative to the cathode and an apertured anode which is preferably 50 volts, and at most 125 volts, positive relative to the cathode. Because of the low positive voltage on the anode, the lens formed by the electrodes has a very large focal distance relative to the dimensions of the electron gun so that there is no cross-over of the beam in the region between the cathode and the anode. Although such arrangements, by eliminating the cross-over, reduce interactions between the electrons and hence reduce the energy spread in the beam, they, nevertheless, have several disadvantages.

One such drawback is that a "no crossover gun," when used in a camera tube with a magnetic focussing lens, produces an interference signal due to the effects of the return beam. The term "return beam" as used herein refers to that portion of the primary electron beam incident on the target which returns from the target back towards the electron gun end of the tube. The return beam is comprised primarily of electrons reflected from the target and the electrons in the primary beam which are not accepted by the target, because, particularly at low incident light intensities, portions of the scanned target are at nearly the same or even slightly negative potential with respect to the cathode. As the electrons in the return beam travel back towards the gun end of the tube, they are focussed by the magnetic lens onto the anode of the electron gun and scanned across it by the deflection coil system resulting in an emission of secondary electrons. The secondary electrons and the electrons in the return beam which are reflected from the anode have energies corresponding to the anode potential, which in an electron gun without a cross-over is close to the cathode potential. Since the energy levels of these electrons are comparable to the energy of the electrons in the primary beam, the secondary and reflected electrons will once again be focussed on and scanned across the target producing an interference signal which appears as a "dark spot" in the visual image.

Another significant problem with guns of this type is that during operation, it is often necessary to vary the beam current by a factor of 5 to 10. In electron guns without cross-over, the beam current is directly proportional to the cathode current and therefore any increase in the beam current also increases the cathode current by the same factor resulting in a heavy load on the cathode. Furthermore, in systems wherein dynamic beam control is effected by feedback coupling of the video signal to the anode, control signals with large amplitudes are required to vary the beam current.

The object of the invention is to provide an electron gun for generating an electron beam with low beam temperature which substantially eliminates the interference signal due to the return beam effect and in which the beam current may be varied with relatively low cathode loading and a control signal of relatively small amplitude variation.

SUMMARY OF THE INVENTION

The electron gun of the invention comprises a cathode and a first anode which is at a positive potential between 5 and 30 volts with respect to the cathode so as to extract electrons from the cathode. The gun further comprises a second, apertured anode spaced from the first anode and operated at a relatively high positive potential of between 100 and 300 volts with respect to the cathode. The distance between the first and second anodes and the respective potentials are such that the two anodes form an electron lens which focusses the electrons emitted from the cathode to a spot or cross-over along the beam axis in the region between the anodes. The aperture in the first anode is sufficiently small so that the cathode emission is substantially unaffected by the lens field in the region between the anodes. The aperture in the second anode serves to limit the cross-section of the beem and its size is chosen to give the desired beam diameter.

During operation of the electron gun, the beam current may be varied by varying the potential applied to the first anode. In addition to producing a corresponding change in the cathode current, this also produces a change in the lens field in the region between the anodes such that the cross-over moves closer to or further away from the aperture in the second anode resulting in an increase or decrease, respectively, of the beam current since a larger portion of the beam passes through the aperture when the cross-over moves closer to the second anode and vice versa. The change in the beam current due to the movement of the cross-over is at least as large, or larger than that produced by the variation in the cathode current due to the increase or decrease of the first anode voltage. Accordingly, this arrangement thus permits the dynamic beam current control to be effected with a control signal of relatively small amplitude variation and, moreover, large increases in the beam current can be obtained without undue loading of the cathode.

As stated earlier, the electron gun of the invention is particularly suited for use in a camera tube, for example, of the vidicon type. In accordance with the invention, the electron gun is mounted at one end of the tube envelope with the cathode and the anodes spaced along and centered about the tube axis, the requisite voltages being supplied to the sun via connecting pins extending through the envelope. The opposite end of the envelope is provided with a window panel and a photosensitive target arranged near or on the inner surface of the window with a transparent signal plate disposed therebetween. The camera tube further includes an electron lens whose parameters are chosen so that the aperture in the second anode is imaged onto the target to produce an electron spot which is scanned across the target by a deflection coil system mounted about the tube envelope.

In addition to the features discussed above, another important characteristic of the electron gun in accordance with the invention is that it substantially eliminates the effect of the return beam in the camera tube. The reason for this is that the second electrode is at a relatively high positive potential of approximately +300 volts with respect to the cathode. Thus, when the electrons in the return beam return to and strike the second anode, the energy of the released secondary electrons will have a sufficiently different energy distribution from that of the electrons in the primary beam so that they will not be focused to a spot onto the target by the focusing coil as they travel through the focusing field back to the target. As a result, this construction substantially eliminates the dark spot in the visual image resulting from the return beam effect in tubes with prior art electron guns of the type described above.

BRIEF DESCRIPTION OF THE DRAWINGS

The invention will now be described in greater detail with reference to the following drawings wherein.

DETAILED DESCRIPTION OF THE INVENTION

Figure 1:
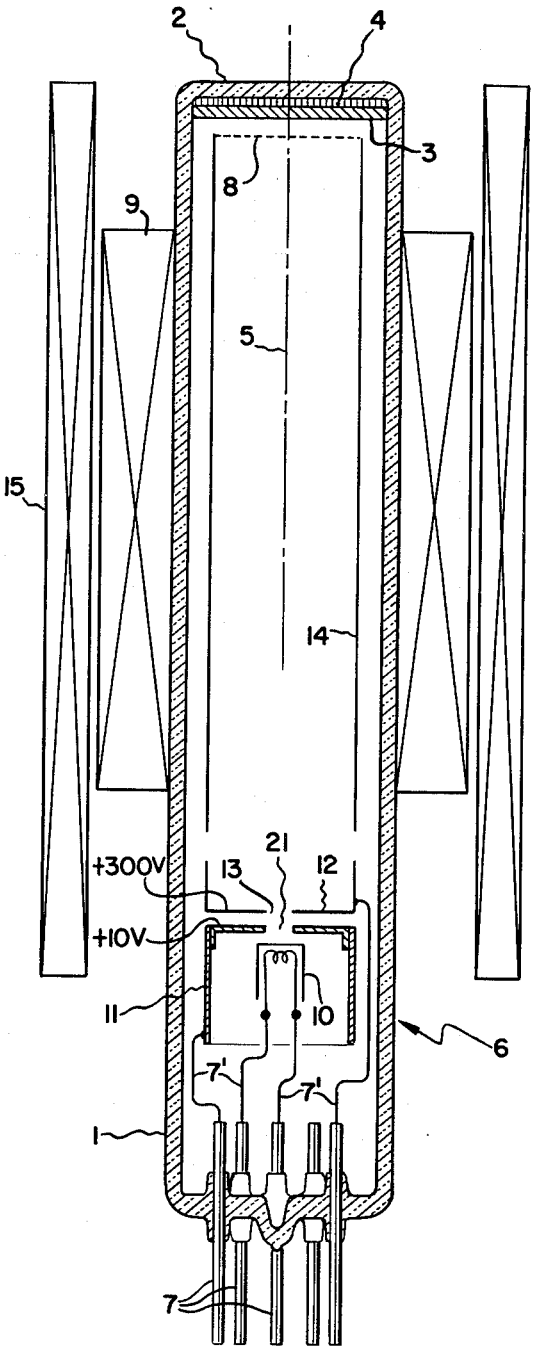
FIG. 1 is a cross-sectional view of a camera tube with an electron gun in accordance with the invention.

The camera tube shown in FIG. 1 is of the vidicon type and comprises a glass envelope 1 having a window plate 2 secured to one end thereof. Arranged near the inner surface of the window panel 2 is a photosensitive target 3 with a conductive, transparent signal plate 4 positioned between the target and the window panel. The target may be made of a photoconductive material such as specially activated lead monoxide, PbO, and the conductive signal plate may, for example, be a layer of tin dioxide applied to the surface of the target. The electron gun, generally indicated by reference character 6, is mounted in the opposite end of the tube envelope. The gun includes a cathode 10, a first anode 11 with an aperture 21 opposite the cathode and a second anode 12 provided with a central aperture 13. The cathode and the two anodes 11 and 12 are spaced along and centered about the tube axis 5 so that the apertures 21 and 13 are concentric with the tube axis. The requisite voltages are supplied to the various electrodes by leads 7' connected to pins 7 which extend through the envelope.

The camera tube further comprises a drift tube 14 enclosing a field free space through which the beam generated by the electron gun 6 travels on its way to the target 3. The electron beam is focussed on the target by focussing coils 15 disposed about the tube envelope. The deflection coils 9 arranged between the focussing coils and the tube envelope deflect the beam aross the target in two mutually perpendicular directions. A mesh electrode 8 positioned in front of the target 3 deflects the electron beam so that the angle of beam incidence is substantially normal to the target.

Figure 2:
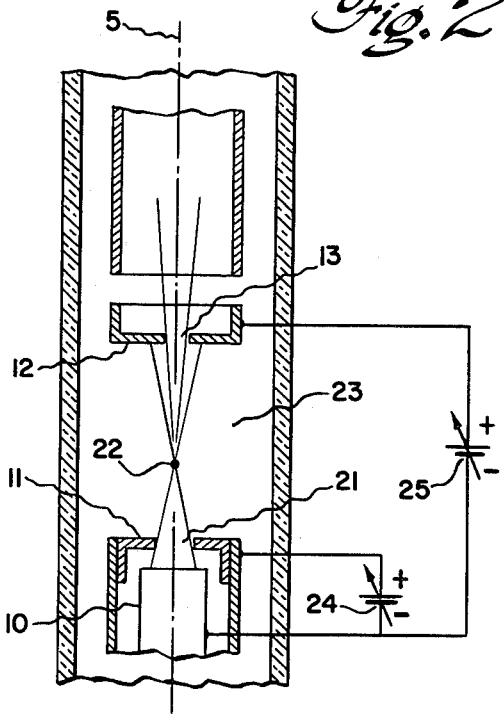
FIG. 2 is a detail illustrating the electron gun in accordance with the invention.

Referring now to FIG. 2, which shows the electron gun of the invention in greater detail, the first anode 11 is connected to a variable voltage source 24 and operated at a slight positive potential of 5 to 30 volts with respect to the cathode. The cathode 10 and the first anode 11 form a source of electrons, with the cathode current being determined by the first anode potential. Under typical operating conditions the first anode 11 is at approximately +10 volts with respect to the cathode. The spacing between anodes 11 and 12 and the potential of the latter is chosen such that a lens field is produced in the region between the two electrodes which converges the electrons emitted from the cathode to a cross-over 22 along the tube axis 5 in the region 23 between the two anodes. The second anode 12 is connected to a voltage source 25 and is operated at a potential between +100 and +400 volts and, typically, approximately +300 volts with respect to the cathode. The aperture 21 in the first anode 11 is sufficiently small so that the lens field in region 23 does not affect the cathode emission. The aperture 13 in the second anode 12 is approximately four times smaller than the aperture 21 in the first anode and its diameter is chosen such that the cross-section of the beam is limited to a diameter which the beam focusing coil 15 is designed to accommodate. The second electrode 12, in addition to serving as a beam-limiting element and serving to produce a lens field, serves as an accelerating electrode.

As discussed earlier, with such an arrangement large variations in the beam current can be attained by relatively small changes in the potential of the first anode. An increase in the first anode voltage, in addition to producing an increase in the electrons drawn from the cathode, also produces a change in the lens field in the region 23 such that the cross-over 22 moves closer to the aperture 13 in the second anode 12. Therefore, for a given cathode current, a larger portion of the emitted electrons pass through the aperture 13 resulting in an increase in the beam current which is greater by a factor of two or more than that due to the increased cathode current. This construction, thus, makes it possible to obtain a large increase in the beam current with only a relatively slight increase in the quantity of electrons drawn from the cathode. Similarly, the beam current can be reduced by decreasing the first anode voltage so that the cross-over 22 moves further away from anode 12 decreasing the number of electrons passing through the aperture 13. In this way the beam current can be controlled by signals with a relatively small amplitude variation and minimal changes in the load on the cathode.

In a preferred embodiment, the distance along the tube axis between the cathode 10 and the first anode 11 is 0.3 millimeters and the distance between the first and second anodes is 0.7 millimeters. The diameter of the aperture 21 in the first anode 11 is 0.2 millimeters and the diameter of the aperture 13 in the second anode is 0.05 millimeters. The first and second anodes are operated at +10 volts and +300 volts, respectively, relative to the cathode.

Figure 3:
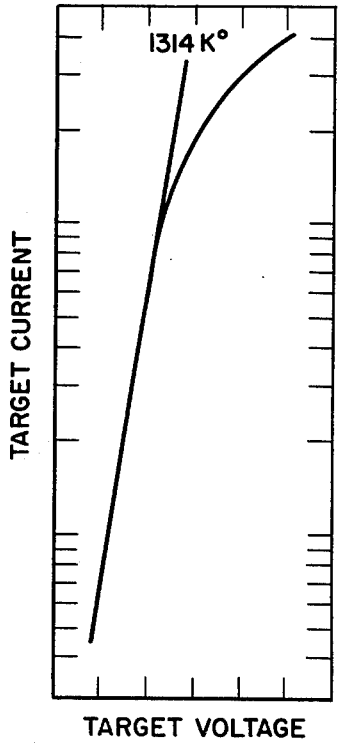
FIG. 3 is a graph showing the beam acceptance curve of the electron gun in accordance with the invention.

The acceptance curve of the tube with an electron gun of the above-described construction is shown in FIG. 3. The acceptance curve is a plot of the current accepted by the target as a function of the potential difference between the target and the cathode. The accepted current is plotted to a logorithmetic scale on the vertical axis and the potential difference is plotted to a linear scale on the horizontal axis.

The acceptance curve is related to the velocity spread of the electron beam. The velocity distribution, in turn, can be expressed as the "temperature" of the beam since a given velocity spread can be regarded as being due to a cathode temperature whose Maxwellian distribution best corresponds to that velocity spread. Thus for two tubes operating at the same cathode temperature, the difference between their respective beam temperatures gives an indication of the velocity distribution or noise in the respective electron beams.

The beam temperature of a given tube can be derived from its acceptance curve. At large positive potentials of the target, the entire beam current is accepted since substantially all of the electrons in the beam are able to reach the target. However, as the potential decreases and becomes negative with respect to the cathode, the accepted current decreases since only a correspondingly decreasing number of the more energetic or fast electrons in the beam are able to reach the target. The decrease of the accepted current is exponential and in the log I versus V plot of FIG. 3 is represented by the central linear region of the curve. The exponential region of the acceptance curve thus resembles the Maxwellian law distribution, which is also exponential, and the beam temperature can therefore be derived from the slope of the exponential region, i.e. the linear portion of the log I versus V acceptance curve. As stated earlier, for the same operating condition, the difference between the beam temperatures of two tubes corresponds to the difference between their velocity distributions and, hence, gives an indication of their performance.

FIG. 3 shows an acceptance curve and the derived beam temperature for the electron gun of the invention. From the figure it can be seen that the electron gun of the invention has a beam temperature of 1314° K. This value is significantly lower than that attainable in tubes with conventional triode guns which typically have a beam temperature between 1900° K. and 2350° K. under comparable operating conditions. Moreover, despite the fact that in the gun of the invention the electrons emitted from the cathode are converged to a cross-over, the beam temperature is only slightly higher than the 1200° K. beam temperature typically attained in tubes with known guns without a cross-over. A camera tube with an electron gun of the invention produces a beam with a temperature between 1300° K. and 1500° K. and will thus give a response rate comparable to known gun without beam cross-over with the added significant advantages in that it eliminates the effects of the return beam and, moreover, permits the beam current to be dynamically controlled with a considerably lower cathode load and a smaller control signal then would be necessary in guns of known construction.

Although the electron gun of the invention has been described with reference to a camera tube it should be understood that it may be used with a number of other electron tubes such as pyroelectric vidicons, display tubes and the like.

I claim:

1. An electron gun for generating an electron beam comprising a cathode, a first electrode spaced from said cathode along an axis extending through said cathode, said first electrode having an aperture generally concentric with said axis, means for applying to said first electrode a first voltage which is positive with respect to and is sufficient to extract electrons from said cathode, a second electrode spaced from said first electrode along said axis and means for applying to said second electrode a second voltage which is positive with respect to said cathode and is sufficiently higher than said first voltage to produce an electric field in the region between said first and second electrodes defining an electron lens for converging the electrons emitted from said cathode to a cross-over in said region, said second electrode having formed therein a beam limiting aperture generally concentric with said axis for passing said electrons therethrough to thereby produce said electron beam of a cross-section determined by the size of said beam limiting aperture.

2. The electron gun according to claim 1 wherein said first voltage is between +5 and +30 volts with respect to said cathode and said second voltage is between +100 and +400 volts with respect to said cathode.

3. The tube according to claim 1 wherein said aperture in said first electrode is sufficiently small so that emission of electrons from said cathode is substantially unaffected by said field in said region between said first and second electrodes.

4. An electron beam tube comprising an envelope having an axis extending therethrough, means arranged in said envelope for producing an electron beam, said beam producing means including a cathode disposed along said axis, a first electrode spaced from said cathode along said axis and having an aperture generally concentric with said axis, means for applying to said first electrode a first voltage which is positive with respect to and is sufficient to extract electrons from said cathode, a second electrode spaced from said first electrode along said axis and means for applying to said second electrode a second voltage which is positive with respect to said cathode and is sufficiently higher than said first voltage to produce an electric field in the region between said first and second electrodes which defines an electron lens for converging the electrons emitted from said cathode to a cross-over along said axis in said region between said electrodes, said second electrode having formed therein a beam limiting aperture generally concentric with said axis for passing said electrons therethrough to thereby produce said electron beam of a cross-section determined by the size of said beam limiting aperture, said tube further comprising a target responsive to electrons arranged within said envelope and in the path of said beam and means for focussing said beam onto said target.

5. The tube according to claim 4 wherein said first voltage is between +5 and +30 volts with respect to said cathode and said second voltage is between +100 and +400 volts with respect to said cathode.

6. The tube according to claims 4 or 5 including means for varying said first voltage to thereby change said lens field so that said cross-over moves closer to or further away from said aperture in said second electrode to thereby increase or decrease, respectively, the current in said beam.

7. The tube according to claim 4 wherein said focussing means includes means for producing a magnetic electron lens field for focussing said beam onto said target and said second voltage is sufficiently high so that electrons returning from said target and striking said second electrode have sufficiently high energy to prevent said focussing means from focussing said last-named electrons to a spot on said target.

8. The tube according to claim 4 wherein said aperture in said first electrode is sufficiently small so that emission of electrons from said cathode is substantially unaffected by said field in said region between said first and second electrodes.

9. A device comprising a camera tube having an elongated envelope with a window at one end thereof, a radiation sensitive target arranged in said envelope near said window and centered about the longitudinal axis of said envelope, means arranged in said envelope for producing an electron beam, said beam producing means including a cathode centered about said axis, a first electrode spaced along said axis from said cathode and having an aperture concentric with said axis, means for applying a first voltage of between 5 and 30 volts positive with respect to said cathode to said first electrode, a second electrode spaced along said axis from said first electrode, means for applying a second voltage of between 100 and 400 volts positive with respect to said cathode to said second electrode to thereby form an electric field in the region between said first and second electrodes which defines an electron lens for converging the electrons emitted from said cathode to a cross-over along said axis in said region between said electrodes, said second electrode having formed therein a beam limiting aperture generally concentric with said axis for passing said electrons therethrough to thereby produce said electron beam of a cross-section determined by the size of said beam limiting aperture, said aperture in said first electrode being sufficiently small so that the emission of electrons from said cathode is substantially unaffected by said field in said region, said device further comprising means for focussing said beam onto said target and means for deflecting said beam across said target.

10. A device for generating an electron beam comprising:

a cathode;

a first electrode spaced from said cathode along an axis extending through said cathode, said first electrode having an aperture generally concentric with said axis;

means for applying to said first electrode a first voltage which is positive with respect to and is sufficient to extract electrons from said cathode;

a second electrode spaced from said first electrode along said axis, the first electrode being between the cathode and said second electrode; and means for applying to said second electrode a second voltage which is positive with respect to said cathode and is sufficiently higher than said first voltage to produce an electric field defining an electron lens for converging the electrons emitted from said cathode to a crossover in the region between the first and second electrode.

* * * * *